United States Patent [19]

Tao

[11] Patent Number: 4,563,164

[45] Date of Patent: Jan. 7, 1986

[54] TWO WHEELED TOY VEHICLE

[75] Inventor: Masahiro Tao, Narashino, Japan

[73] Assignee: Asahi Corporation, Tokyo, Japan

[21] Appl. No.: 592,014

[22] Filed: Mar. 21, 1984

[51] Int. Cl.[4] ..... A63H 17/16; A63H 29/24; A63H 17/25

[52] U.S. Cl. ..... 446/440; 446/463; 446/275; 74/572

[58] Field of Search ..... 446/462, 29, 279, 288, 446/325, 326, 461, 463, 464, 440, 454, 457, 275; 74/572, 380, 384; 185/DIG. 1

[56] References Cited

U.S. PATENT DOCUMENTS

| | | | |
|---|---|---|---|
| 2,624,154 | 1/1953 | Plawner | 446/216 |
| 2,645,056 | 7/1953 | Mangold | 446/279 |
| 2,698,497 | 1/1955 | Müller | 446/279 |
| 2,726,482 | 12/1955 | Roehrl et al. | 446/448 |
| 3,919,804 | 11/1975 | Nakata | 446/464 |
| 4,059,918 | 11/1977 | Matsushiro | 446/463 X |
| 4,290,228 | 9/1981 | Goldfarb et al. | 446/456 X |
| 4,363,185 | 12/1982 | Masubuchi | 446/462 |
| 4,363,186 | 12/1982 | Goldfarb et al. | 446/440 X |
| 4,387,604 | 6/1983 | Maher | 446/462 |
| 44,475,305 | 10/1984 | Kawakami et al. | 446/463 |

FOREIGN PATENT DOCUMENTS

| | | | |
|---|---|---|---|
| 3318154 | 2/1984 | Fed. Rep. of Germany | 446/440 |
| 2358175 | 10/1978 | France | 446/462 |
| 2008959 | 10/1978 | United Kingdom . | |

*Primary Examiner*—Robert A. Hafer
*Assistant Examiner*—D. Neal Muir
*Attorney, Agent, or Firm*—Fleit, Jacobson, Cohn & Price

[57] ABSTRACT

A two wheeled toy vehicle with a driving mechanism having a frictional driven wheel, an inertia type flywheel, two gear trains with a clutch gear driving apparatus and an operating member of the clutch gear driving apparatus. One of the gear trains is a gear wheel of a rear wheel, a clutch gear and a floating gear and a first non-displaceable gear and a flywheel gear, and the other of the gear trains is for transmission of rotation from the flywheel to the rear wheel through a second non-displaceable gear, and the clutch gear. The clutch gear is disposed on a movable clutch axle which is connected to the operating member of the clutch gear driving axle which is connected to the operating member of the clutch gear driving apparatus on which a doll is pivotally mounted. The doll has a pair of legs pivotally mounted on a frame and is mounted astride the toy vehicle. After the frictional driven wheel is energized and rotated by pushing the vehicle along a friction surface to rotate the flywheel at high speed, and when the doll is brought to a downward position, the legs leave the friction surface and the vehicle is set free. The inertia rotation of the flywheel is reversely transmitted back to the rear wheel, and the vehicle is simultaneously driven forward.

4 Claims, 5 Drawing Figures

TWO WHEELED TOY VEHICLE

FIELD OF THE INVENTION

The invention relates to an improved and new two wheeled toy vehicle with an inertia type flywheel and with a doll of a driver which is mounted astride thereon, particularly to a two wheeled toy vehicle having a driver doll which is used as an operating member for a clutch gear driving means. The doll supports the vehicle by the legs when an upper portion of the doll raises up and a rear wheel is energized and rotated by pushing the vehicle along a friction surface to rotate the flywheel at high speed. When the driver is brought down, the supports by the legs leave from a friction surface and the vehicle gets free, and the inertia rotation of the flywheel is reversely transmitted back to the rear wheel, and the vehicle simultaneously drives.

BACKGROUND OF THE INVENTION

A conventional toy vehicle with a flywheel comprises a gear train in a driving mechanism for transmission of the rotation of wheels which are driven by friction, to the flywheel, and for reverse transmission of the rotation of the flywheel to the wheel. A same gear train is used to transmit energy which is produced by rotation of the wheels to the flywheel, and to reversely transmit the energy of the flywheel rotation back to the wheels. Therefore, wear of the gear train easily occurs and the toy vehicle frequently becomes broken down due to damage of the gear train.

SUMMARY OF THE INVENTION

The present invention of driving mechanisms includes two groups of gear trains, one is for a mechanism of energizing a flywheel and the other is for a mechanism of transmitting the rotation mechanism from the energized flywheel to the vehicle wheel. The former comprises a gear wheel, a clutch gear means which is movable about the gear wheel, a floatable gear means which is releasably engaged with the clutch gear means, first non-displaceable gear means which is releasably engaged with the floatable gear means, and a flywheel gear means which is mounted on an axle of flywheel and is engaged with the first non-displaceable gear means. And the latter comprises the flywheel gear means, the first non-displaceable gear means which is always engaged with the flywheel gear means, second non-displaceable gear means which is always engaged with the first non-displaceable gear means, the clutch gear means which is releasably engaged with the second non-displaceable gear means, and said gear wheel which is relatively movable but always engaged with the clutch gear means.

Accordingly, a principal object of the present invention is to provide two wheeled toy vehicle with an inertia type flywheel including a driving mechanism which comprises two groups of gear trains for energizing a flywheel, and for reversely transmitting the rotation of the energized flywheel to a frictional driven wheel.

Another object of the present invention is to provide a two wheeled toy vehicle with an inertia type flywheel and a frictional driven wheel interconnected by two gear trains which are releasable to reduce loss of energy of the rotation, to smooth engagement each other, to maintain a driving of the toy vehicle a long time, and to reduce damage of the gear means.

Other objects and many of the attendant advantages of the invention will be readily appreciated as the same become better understood by reference to the following description on bases of the attached drawings.

BRIEF DESCRIPTION OF THE DRAWINGS

The accompanying drawings illustrate the preferred embodiment of the present invention. In the drawings, the same reference numerals illustrate the same parts of the invention, in which.

DETAILED DESCRIPTION OF THE INVENTION

Figure 1:
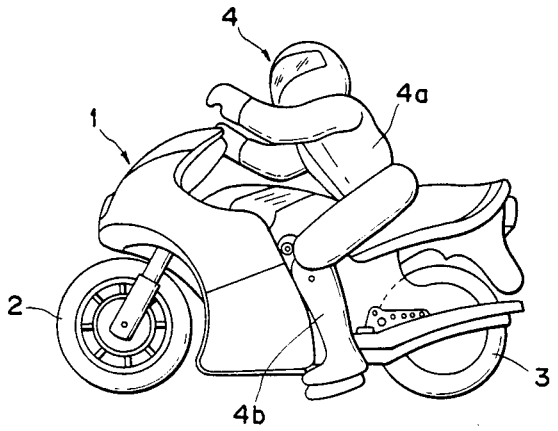
FIG. 1 is a perspective view of a two wheeled toy vehicle of the present invention.
Figure 2:
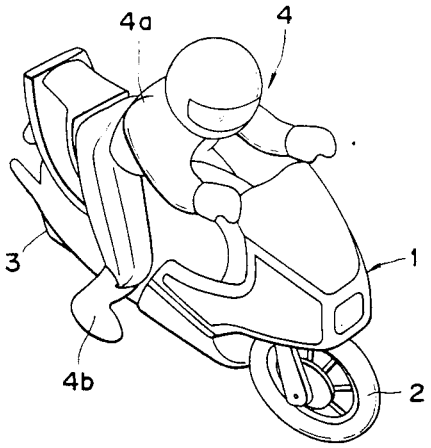
FIG. 2 is a perspective view of the vehicle shown from other angle.

In FIGS. 1 and 2, perspective views from respectively different angles of an embodiment of a two wheeled toy vehicle of the present invention is shown. In the drawings, a numeral 1 shows a whole body of the two wheeled toy vehicle, a numeral 2 shows a front wheel, a numeral 3 shows a frictional driven rear wheel of the vehicle, and a numeral 4 shows a whole body of a doll which operates a clutch gear driving means. A numeral 4*a* shows an upper part of the doll 4 including a head thereof, and a numeral 4*b* shows both leg members of the doll of a driver.

Figure 3:
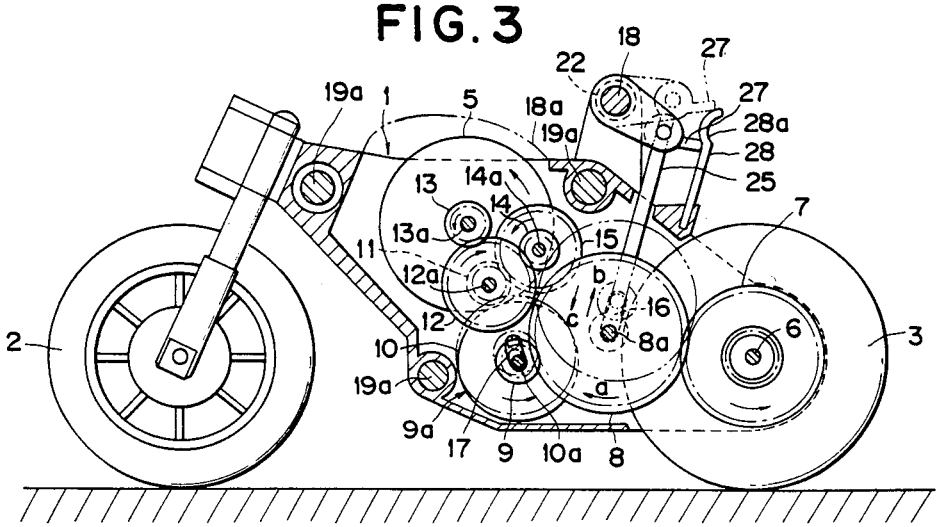
FIG. 3 is a partially cross sectional side view of the vehicle showing a driving mechanism.

The FIG. 3 shows relationship between the rear wheel 3 of a frictional driven vehicle wheel and a driving mechanism for an inertia type flywheel 5. The driving mechanism comprises two groups of gear trains. One of the gear trains comprises a series of a wheel gear 7 mounted on a axle 6 of the rear wheel 3, a slidable clutch gear 8 engaged with the gear wheel 7, a floatable gear means 9*a* consisted of a pinion 9 and a gear 10, first non-displaceable gear means consisted of a pinion 11 and a gear 12, and a pinion 13 as a flywheel gear means mounted on an axle of the inertia type flywheel 5. The other of the trains comprises a series of the pinion 13 of the flywheel 5, the gear 12, the pinion 11, second non-displaceable gear means consisted of a gear 15 and a pinion 14, the clutch gear 8, and the gear wheel 7 of the rear wheel 3.

With regard to the first gear train, the clutch gear 8 is mounted on a movable clutch axle 8*a*, and the two ends of the axle 8*a* are movably inserted and received in parallel slots 16 which are formed in side walls 19 of a casing of the mechanism. The clutch gear 8 always engages with the gear wheel 7 of the rear wheel 3.

The floatable gear means 9*a* consists of both the pinion 9 and the gear 10 which are mounted on a floatable axle 10*a*, and the two ends of the axle 10*a* are floatably inserted and received in parallel arcuate slots 17 which are formed in the side walls 19 of the casing. The clutch gear 8 engages releasably with the pinion 9 of the floatable gear means 9*a*.

The pinion 11 and the gear 12 are mounted on a same axle 12*b*, and two ends of the axle 12*b* are rotatably received in the aligned bearing holes 12*a* which are formed in the side walls 19 of the casing. The gear 10 of the floatable gear means 9*a* engages releasably with the pinion 11.

The pinion 13 is mounted on a flywheel axle 13*b* of the flywheel 15, and two ends of the axle 13*b* are rotatably received in aligned bearing holes 13*a* which are formed in the side walls 19 of the casing. The gear 12 engages always with the pinion 13 of the flywheel 5.

With regard to the second gear train of the gear means, the pinion 14 and the gear 15 are mounted on a same axle, and two ends of the axle are rotatably received in aligned bearing holes 14*a* which are formed in the side walls 19 of the casing. The gear 15 engages always with the pinion 11, and the clutch gear 8 engages releasably with the pinion 14 when the clutch gear 8 is operably slided upwardly along the slots 16.

Figure 4:
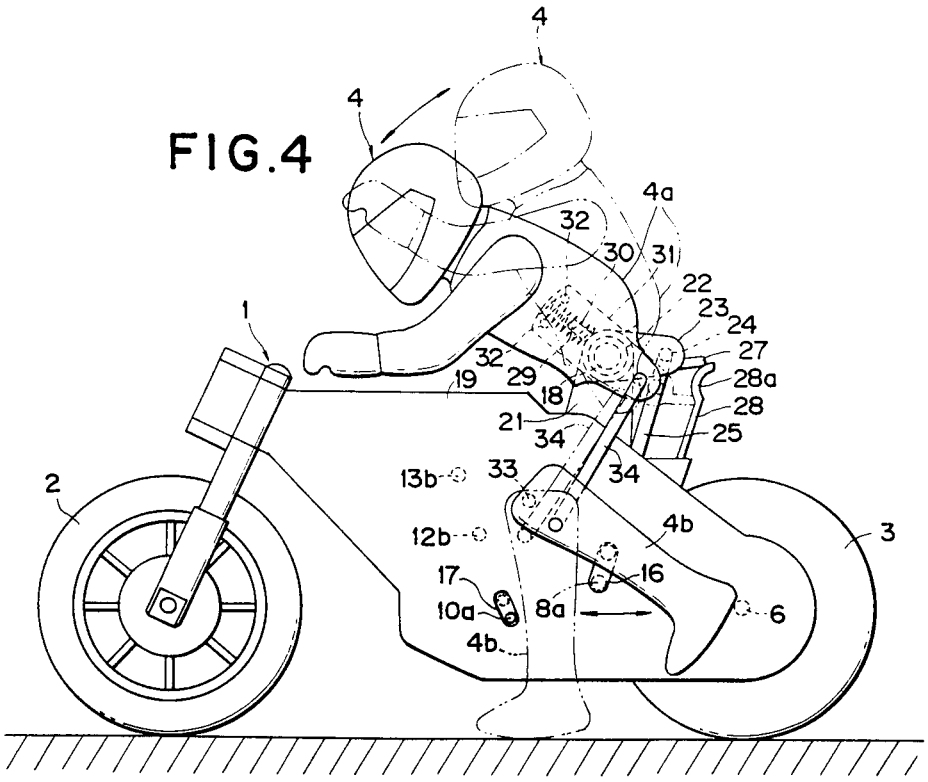
FIG. 4 is an explanatory side view showing a manner to start the vehicle.
Figure 5:
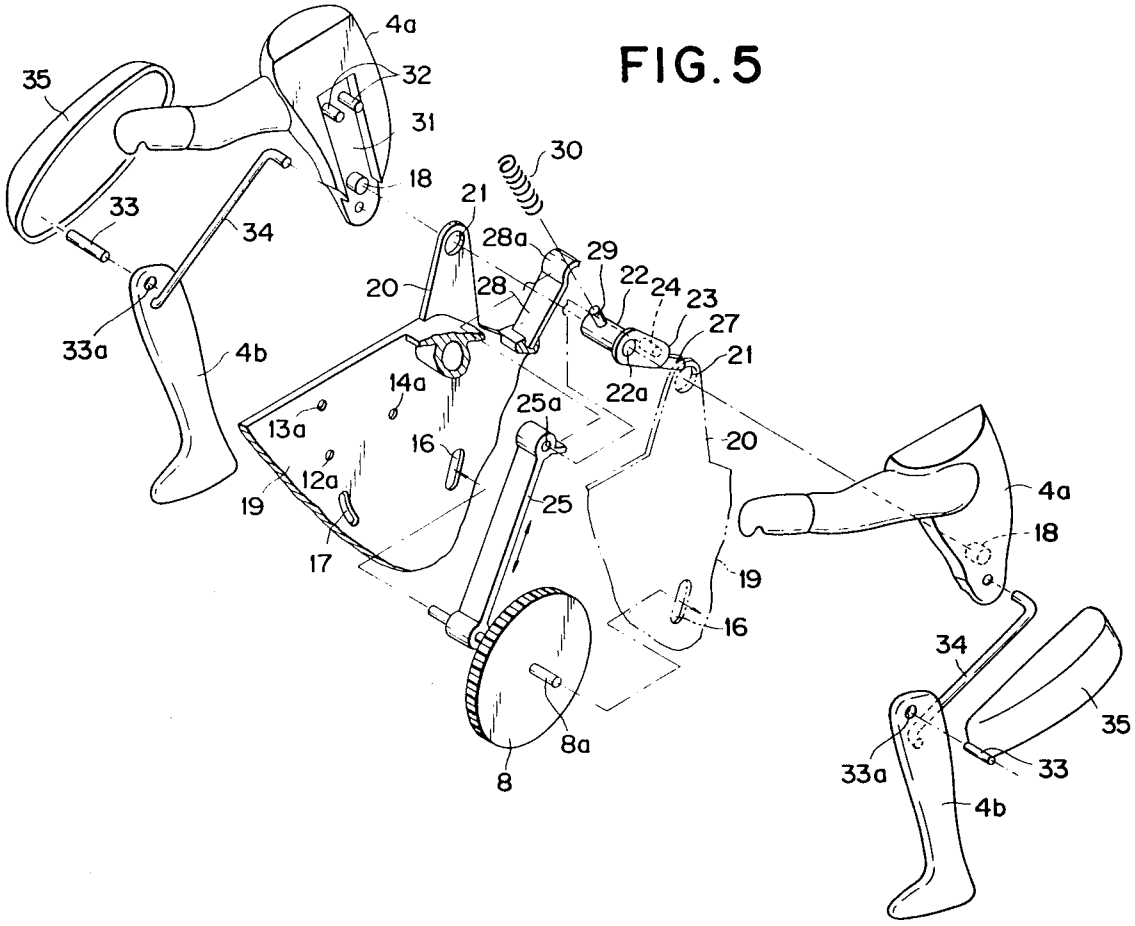
FIG. 5 is an exploded perspective view showing specifically slots and openings in a casing and a clutch gear operating member.

In FIGS. 4 and 5, relationship between the two wheeled toy vehicle 1 and the doll 4 of the operating member to move an apparatus as the clutch gear driving means is shown. Half pieces of the upper part 4*a* of the driver 4 have respectively a pivotable axle 18 at a lower portion thereof and have respectively a small hole for connecting a rod 34 at a lower end portion. Both parallel side walls 19 of the casing have respectively a bracket 20 provided parallel at an upper portion, and aligned holes 21 are formed in the upper portion of the brackets 20. A crank means comprises a hollow crank shaft 22 which has a longitudinal hole 22*a*, and has a crank arm 23 at one side thereof. The crank arm 23 has a crank pin 24 and a projected piece 27 to set up at a position, and the crank shaft 22 has an extended perpendicular supporting pin 29 as shown in FIG. 5.

A connecting shaft 25 is mounted on the movable clutch axle 8*a* of the clutch gear means, and a hole 25*a* to receive the crank pin 24 is formed at an upper end of the connecting rod 25 and a protruded portion is provided on the upper end thereof.

A leaf spring member 28 is fixed at a rear upper end of the side wall 19, and the leaf spring member 28 has an arcuated convex portion 28*a* at the upper end portion. A coil spring member 30 is set on the supporting pin 29.

One of the half pieces of the upper part 4*a* of the doll 4 has a pair of supporting pins 32 extended from a concave portion 31 provided at an inside thereof.

A hole 33*a* is respectively formed at upper end portions of a pair of legs 4*b*, to pivotally receive a pin 33 which is extended through the hole 33*a* and received pivotally on the side wall 19.

A pair of the covers 35 are covered on the connecting rods 34 at both sides, which the cover 35 operates as a thigh member.

When all the members are assembled, the connecting shaft 25 is rotatably connected to the crank pin 24 of the crank shaft 22 by insertion of the crank pin 24 into the hole 25*a*. The coil spring 30 is fitted on the supporting pin 29 extended from the crank shaft 22, and the coil spring 30 is compressingly placed between a pair of the supporting pins 32 extended inwardly from the half piece of the driver. Both axles 18 extended inwardly from the inside of the half pieces of the driver 4 are respectively inserted into the hole 22*a* of the crank shaft 22 through the hole 21 of the bracket 20, and also the above stated gear means are placed between the side walls 19 of the casing.

The projected piece 27 of the crank arm 23 and the protruded portion of the connecting shaft 25 are placed to slidably push with the arcuated convex portion 28*a* of the leaf spring member 28. When the upper part 4*a* of the driver 4 is raised up, the tip of the projected piece 27 and the protruded portion contact with the lower portion of the spring convex portion 28*a*, and when the upper part 4*a* of the driver 4 is brought down forward, the tip of the projected piece 27 and the protruded portion slide pushingly on the spring convex portion 28*a* and fit on the upper end portion of the convex portion 28*a* shown by a solid line and a phantom line with regard to the crank arm in FIGS. 3 and 4.

The half pieces of the upper part 4*a* of the driver 4 are connected each other to attached the bracket 20 in the concave portion 31 pivotably by engagement of the axle 18 in the hole 21. When the members are assembled the side walls are fixed by pin members 19*a*. A pair of the connecting rods 34 is respectively connected to the upper part 4*a* of the doll 4, that is, a bent end of the connecting rod 34 is inserted into the hole formed at the lower end of the upper part 4*a* of the doll 4, and the other bent end of the connecting rod 34 is inserted into the hole formed at upper portion of the leg member 4*b*. A pair of the leg members is pivotally attached to the frame of the vehicle by the pivotal pins 33 respectively. The pin 33 is inserted into the hole 33*a*. A pair of covers 35 of thigh members is attached between the lower portion of the upper part 4*a* of the doll and the upper portion of the leg member 4*b* to cover the connecting rod 34 respectively, that is, both ends so the cover 35 are respectively attached on the lower portion of the upper part 4*a* and on the top of the leg member 4*b*, and the cover moves as a thigh member in accordance with the pivotal movement by operation of raising and bringing down of the upper part 4*a* the driver. Both leg members 4*b* are connected to the upper part 4*a* of the driver 4 through the connecting rod 34, and the leg members 4*b* are movably attached to the outside of the frame by the pins 33 respectively to bestride the vehicle 1.

A cover member 18*a* is mounted on the casing to cover the mechanism of the gear means as shown by a phantom line in FIG. 3.

When the upper part 4*a* of the driver 4 is raised, the connecting shaft 34 moves downwardly as shown by an arrow head c in FIG. 3, the leg members 4*b* to be able to contact on and to support the toy vehicle on the frictional surface such as a floor as shown by the phantom line in FIG. 4. In this manner, the rear wheel 3 is slightly raised to detach the feet from the frictional surface and the rear wheel 3 is rotated and energized by pushing the vehicle along the friction surface quickly many times to get the flywheel high speed rotation, and the rotation of the rear wheel 3 is transmitted by a gear wheel 7 which is mounted on the same wheel axle 6 of the rear wheel 3 to the clutch gear means which is positioned to the lower end in relation to the slot 16. The clutch axle 8*a* of the clutch gear means is placed in the lower end of the slot 16 where is the lower stationary position of the connecting shaft 25, and the projected piece 27 is engaged to the lower end of the arcuated convex portion 28*a* of the leaf spring member to keep the connecting shaft 25 at the stationary position.

The clutch gear 8 engages with the floatable gear means 9*a* which is floated along the slot 17 in accordance with rotation of the clutch gear 8 as shown by an arrow head a in FIG. 3, that is, the clutch gear 8 engages with the pinion 9 of the floatably gear means 9*a*. In accordance with floating movement of the gear means 9*a*, the floatable axle 10*a* moves upwardly in the slot 17. The gear 10 of the floatable gear means 9*a* engages with the pinion 11. The gear 12 which is mounted the same axle 12*b* of the pinion 11 engages with the pinion 13 of the flywheel 5. Therefore, the rotation of the clutch gear 8 is transmitted to the floatable gear means 9*a* and to flywheel through the interconnecting gear means of the pinion 11, the gear 12 and the flywheel pinion 13. When the pinion 11 rotates, the gear 15 which is engaged with the pinion 11 rotates.

When the rear wheel 3 is stopped rotating, the clutch gear 8 stopped rotating and the floatable gear means 9*a* falls along the slot 17 and the engagement between the floatable gear means 9*a* and the pinion 11 is released. Therefore, the energized flywheel rotation is not transmitted to the floatable gear means 9*a*, the gear 8 and the rear wheel 3. Accordingly, loss of energy of rotation of the flywheel 5 is reduced.

During the inertia rotation of the flywheel and stopping rotation of the rear wheel 3, when the upper part 4*a* of the doll 4 is brought down, the crank shaft 22 is rotated, and the crank arm 23 moves upwardly by the rotation of the crank shaft 22, and the projected piece 27 extended from the crank arm 23 moves upwardly simultaneously to over the arcuated convex portion of the leaf spring member as shown in a solid line in FIG. 4. By the movement of the crank arm 23, the connecting shaft 25 is moved upwardly along the slot 16 as shown by an arrow head b in FIG. 3, and the movable clutch axle 8*a* attached the connecting shaft 25 moves upwardly in the slot 16 and the clutch gear slides upwardly along the gear wheel 7.

When the clutch gear 8 is upwardly moved along the slot 16, the clutch gear 8 is meshed with the gear 7 of the rear wheel 3, and the clutch gear 8 engages with the rotating pinion 14. Simultaneously, the leg members 4*b* of the doll 4 moves to rear upward, therefore the leg member of the doll 4 removes from the frictional surface.

Therefore, the inertia rotation of the flywheel 5 is transmitted back to the rear wheel 3 through the interconnected gear 12, the pinion 11, the gear 15, the pinion 14, the clutch gear 8 and the gear 7 of the rear wheel 3. And the two wheeled toy vehicle 1 starts forwardly by the force of the energized flywheel rotation until the force or energy of rotation reduces.

It is achieved to change the gear trains by the movable clutch gear means, and to maintain the energized rotation of the flywheel, and to transmit the rotation from the vehicle wheels to the flywheel and reversely from the flywheel to the wheels.

As stated above, it is respectively realized that the present invention of the toy wheeled vehicle with the inertia type flywheel has two groups of gear trains which is changable by the clutch gear means for energizing the flywheel and for transmitting the energy of rotation of the flywheel to the vehicle wheels, loss of the kinetic energy of rotation is reduced. And it is possible to smoothly engage the gear trains, and to move the toy vehicle a long time.

Although only limited preferred embodiments of the invention have been illustrated and described, it is anticipated that various changes and modifications will be apparent to those skilled in the art, and that such changes may be made without departing from the scope of the invention as defined by the following claims.

What is claimed is:

1. A two wheeled toy vehicle having a body, a front wheel supported on a first wheel axle, a frictionally driven rear wheel supported on a second wheel axle, an inertia type flywheel mounted on a flywheel axle, and a driving mechanism provided in a casing, said two wheeled toy vehicle comprising:

a. a first driving mechanism for transmitting the frictional rotation of the rear wheel when frictionally driven, to the inertia type flywheel, and having a gear train including
   - a gear wheel mounted on the second wheel axle,
   - a clutch gear means mounted on a movable clutch axle movably supported within parallel slots provided on side wells of a casing, and being in engagement with the gear wheel,
   - a floatable gear means mounted on a floatable axle movably supported within parallel slots provided on the side wall of said casing and engaging releasably with the clutch gear means, and
   - a first non-displaceable gear means mounted on an axle, the floatable gear means releasably engaging said first non-displaceable gear means,
   - a flywheel gear mounted on the flywheel axle and engaging the first non-displaceable gear means;

b. a second driving mechanism for transmitting the rotation of the flywheel back to the rear wheel and having a gear train including
   - a second non-displaceable gear means mounted on an axle, and being coupled to the flywheel gear via the first non-displaceable gear means and being engageable with the clutch gear means when said clutch gear means is released from the floatable gear means and is biased against the second non-displaceable gear means, said gear wheel engaging the clutch gear means;

c. an operating member for actuating a clutch gear driving means; and d. said clutch gear driving means connected on the movable clutch axle to move the clutch gear means between the gear wheel and one of the floatable gear means and the second non-displaceable gear means;

said clutch gear driving means comprises a connecting shaft pivotally supported on a crank arm extending from a crank shaft pivotally supported on brackets of the side walls of the casing of the first driving mechanism, an extended piece of the crank arm being in engagement with a leaf spring member, and the operating member for the clutch gear driving means comprises a doll driver movable coupled via spring means to the crank shaft and including legs pivotally mounted on the side walls by pins and movably connected to a lower portion of the upper part of the doll driver by connecting shafts which are covered by a thigh member, the legs of the doll driver being mounted astride the toy vehicle and supporting the toy vehicle when the flywheel is energized, and the legs being removed from a frictional surface to a rearward position when the rotation of the flywheel is transmitted to the rear wheel.

2. A toy vehicle of claim 1 wherein the clutch gear means constantly engages with the gear wheel, the floatable gear means has a gear and a pinion which releasably engages with the clutch gear means, the first non-displaceable gear means has a gear and a pinion which releasably engages the gear of the floatable gear means, the flywheel gear being formed by a pinion which constantly engages the gear of the first non-displaceable gear means, the second non-displaceable gear means has a respectively a gear which constantly engages with the pinion of the first non-displaceable gear means, and a pinion which releasably engages with the clutch gear means, and the side walls of the casing are parallel and each contains a slot and an arcuate slot, the ends of the movable clutch axle being inserted in the slots to move about said gear wheel, and the ends of the flotable axle of the floatable gear means being floatably inserted in the arcuate slots, and ends of other axles being rotatably mounted in respective bearing holes which are provided in the side walls of the casing.

3. A toy vehicle of claim 1 wherein when the flywheel is to be energized by frictional rotation of the rear wheel, the clutch gear is released from the second non-displaceable gear means by raising the operating member and moving the clutch gear driving means in a downward direction and, after energization and during rotation of the flywheel and after stopping the frictional rotation of the rear wheel, the floatable gear means is released from the first non-displaceable gear means by gravity.

4. A toy vehicle of claim 1 wherein when the operating member is brought down and the clutch gear driving means is operated to engage the clutch gear with the second non-displaceable gear means, the gear train of the first driving mechanism and the second driving mechanism are respectively engaged with each other by said clutch gear to transmit the rotation of the flywheel to the rear wheel.

* * * * *